US006546584B2

(12) United States Patent
Hobden

(10) Patent No.: US 6,546,584 B2
(45) Date of Patent: Apr. 15, 2003

(54) ADJUSTABLE HANDLE FOR A PAINT PAD

(75) Inventor: Edmond C. A. Hobden, Derbyshire (GB)

(73) Assignee: Flock Development & Research Co. Ltd., Stalybridge (GB)

( * ) Notice: Subject to any disclaimer, the term of this patent is extended or adjusted under 35 U.S.C. 154(b) by 0 days.

(21) Appl. No.: 09/844,233

(22) Filed: Apr. 27, 2001

(65) Prior Publication Data

US 2002/0148057 A1 Oct. 17, 2002

Related U.S. Application Data

(60) Provisional application No. 60/284,428, filed on Apr. 17, 2001.

(51) Int. Cl.[7] ..... A46B 5/02; A47L 13/00

(52) U.S. Cl. ..... 15/144.1; 15/145; 15/230.11; 15/209; 15/230; 403/299; 403/58; 403/94

(58) Field of Search ..... 15/144.1, 145, 15/230.11, 209, 230; 16/114; 403/299, 58, 94

(56) References Cited

U.S. PATENT DOCUMENTS

| | | | | | |
|---|---|---|---|---|---|
| 612,491 | A | * | 10/1898 | Eck | 15/111 |
| 2,689,155 | A | | 9/1954 | McIntosh | 306/13 |
| 2,777,148 | A | | 1/1957 | Belsky et al. | 15/228 |
| 3,795,933 | A | * | 3/1974 | Seufert | 15/114 |
| 4,033,010 | A | | 7/1977 | McCalla | 16/114 |
| 4,157,598 | A | * | 6/1979 | Talent et al. | 15/144.3 |
| 4,194,852 | A | | 3/1980 | Cupp et al. | 403/299 |
| 4,219,899 | A | | 9/1980 | Zurawin et al. | 15/144 |
| 4,594,816 | A | | 6/1986 | Goldstein | 51/393 |
| 4,658,461 | A | | 4/1987 | Roe et al. | 15/210 |
| 4,819,294 | A | | 4/1989 | Calvert | 15/209 |
| 4,822,194 | A | | 4/1989 | Simonette | 401/207 |
| 4,929,112 | A | | 5/1990 | Wilcox | 403/93 |
| 5,414,889 | A | | 5/1995 | Sartori | 15/159.1 |
| 5,556,470 | A | | 9/1996 | Gruber | 118/264 |
| 5,868,515 | A | | 2/1999 | Janssen | 403/97 |
| 5,937,471 | A | | 8/1999 | Liao | 15/111 |
| 6,000,090 | A | * | 12/1999 | Sutherland | 15/150 |
| 6,006,393 | A | | 12/1999 | Lynch et al. | 15/144.1 |

* cited by examiner

*Primary Examiner*—Robert J. Warden, Sr.
*Assistant Examiner*—Shay L. Balsis
(74) *Attorney, Agent, or Firm*—Westman, Champlin & Kelly, P.A.

(57) ABSTRACT

A paint pad holder has a pad holder plate with a housing for mounting a handle on the plate. The housing has a guide recess for receiving a head of the handle, and for pivotally mounting the handle for movement about an axis generally parallel to the plane of the pad holder plate. The handle can be pivoted a selected number of degrees relative to the plate, and includes a lock sleeve that can be used for locking the handle in selected angular positions relative to the plate.

10 Claims, 3 Drawing Sheets

ADJUSTABLE HANDLE FOR A PAINT PAD

CROSS REFERENCE TO RELATED APPLICATION

The present application is based on and claims the benefit of U.S. provisional patent application Ser. No. 60/284,428, filed Apr. 17, 2001, the content of which is hereby incorporated by reference in its entirety.

BACKGROUND OF THE INVENTION

The present invention relates to a paint pad holder that has a pad holder plate with a handle attached to the plate on a pivot that permits adjusting the angle of a handle relative to the plane of the pad holder for use in different operating conditions. Additionally, the pad handle can selectively be permitted to "float" about its mounting axis across a wide range of angles.

Various adjustable or flexible handle paint pads have been advanced in the prior art, including units that have a flexible, spring type connection between the paint pad holder and the handle, with an ability to lock the handle in at least one position. A number of paint pad holders also have a universal hinge type joint. Others have handles that lock in a selected number of positions.

An easily molded snap together handle and paint pad holder plate that quickly adjusts between at least two angular positions relative to the handle and also permits free floating of the pad holder plate relative to the handle has not been advanced.

SUMMARY OF THE INVENTION

The present invention relates to a pad holder for applying paint or the like to a suitable object. The holder is a molded plastic part that comprises a plate that supports a conventional paint applying pad, with a molded housing forming a hub for pivotally mounting shaft ends of a removable handle. The handle is snapped into place and guided on a path of pivoting about an axis parallel to the plane of the pad holder plate and attached pad, and with a lock collar that can be locked in a plurality of positions to change the angle of the handle relative to the pad holder plate and pad. Additionally, the lock collar can be placed in a position where it does not engage interfitting lock members on the pad holder plate, and the handle then can swivel or pivot freely relative to the plate across a range of angles so that a pad attached to the pad holder plate can be used on surfaces where the pad assumes angles varying as needed for smooth application.

The pad holder parts are all easily molded and snapped into place, and the pad holder plate will receive and retain standard painting pads.

DETAILED DESCRIPTION OF THE PREFERRED EMBODIMENTS

Figure 1:
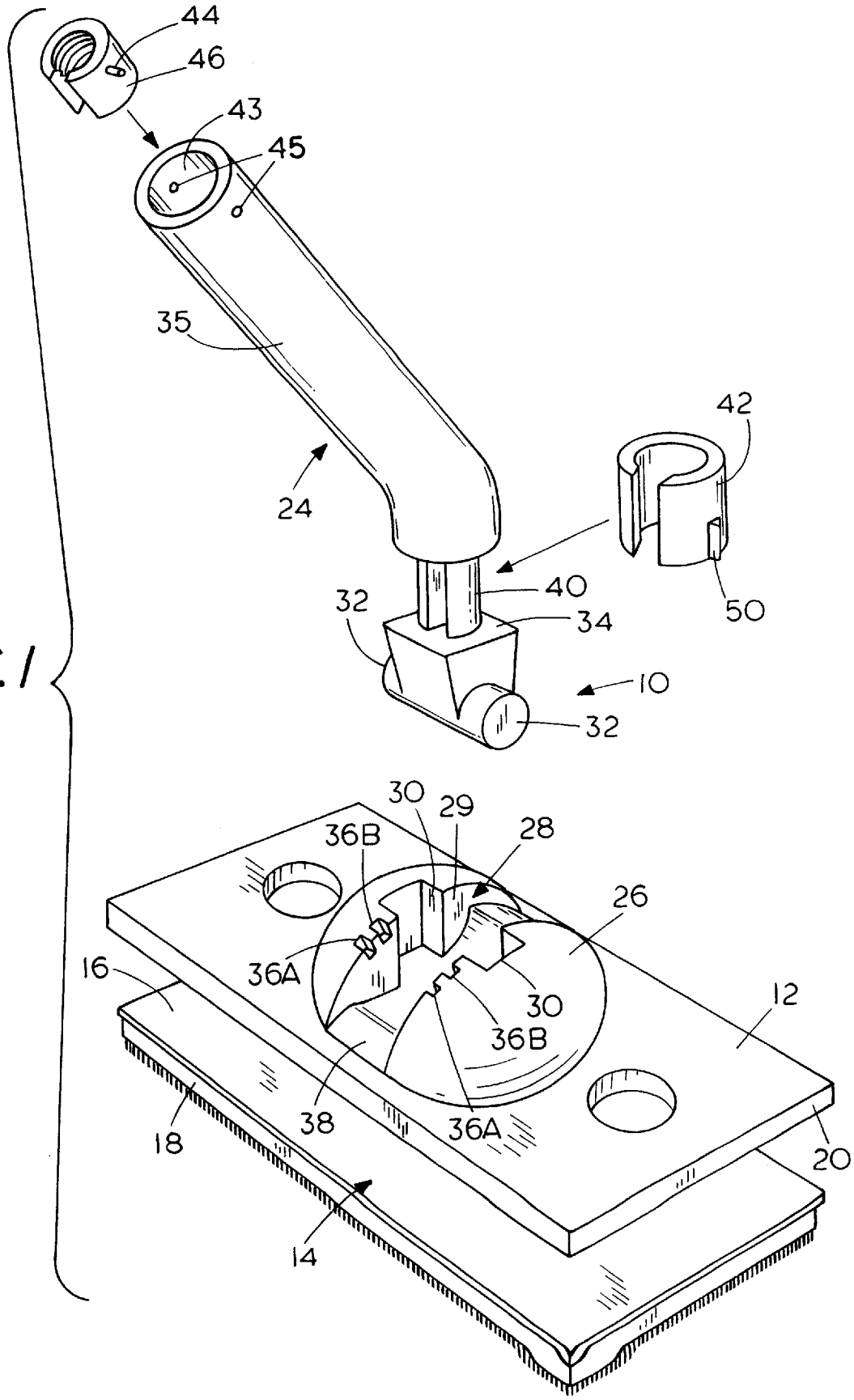
FIG. 1 is an exploded view of a paint pad holder made according to the present invention.
Figure 2:
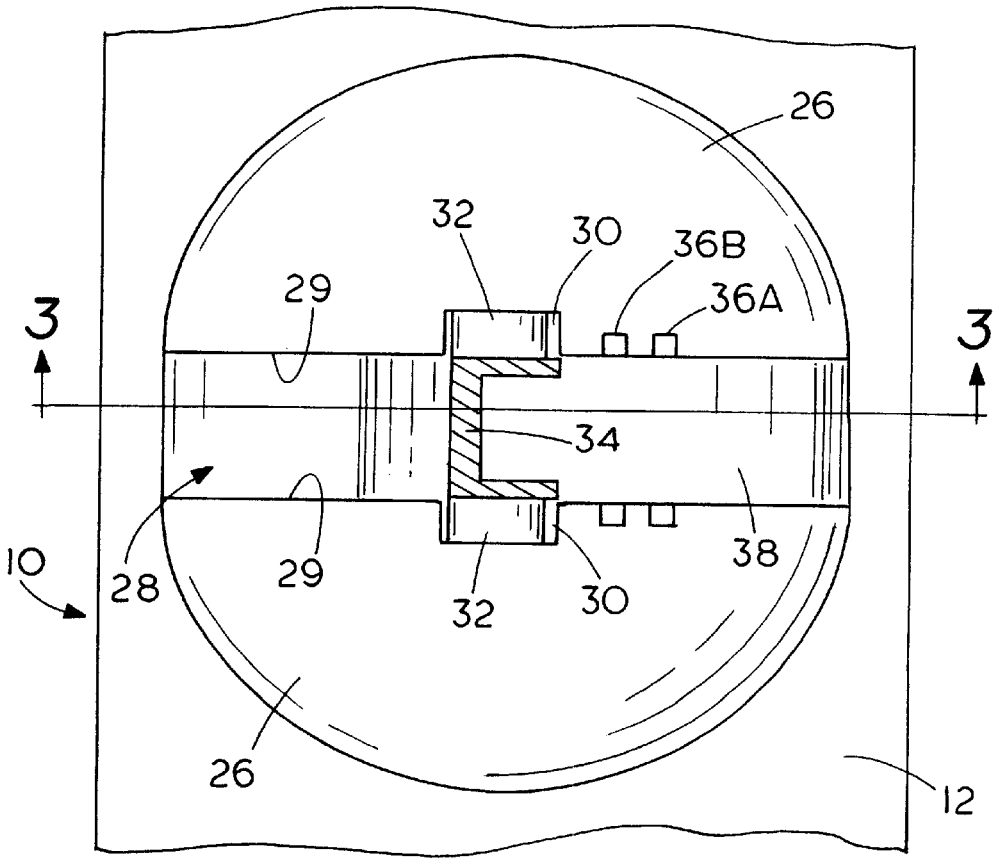
FIG. 2 is a fragmentary top view of the pad holder plate of FIG. 1 with the handle broken away.
Figure 3:
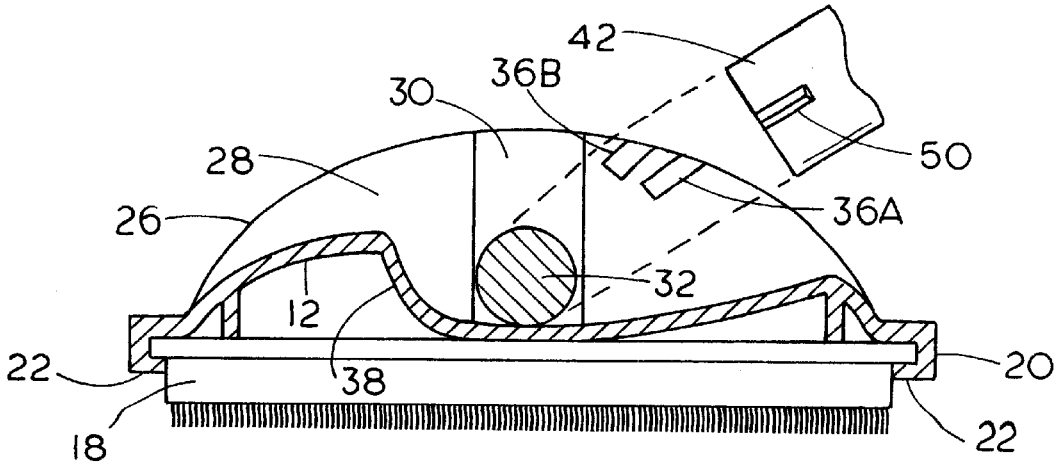
FIG. 3 is a sectional view taken as on line 3—3 in FIG. 2.
Figures 4, 5:
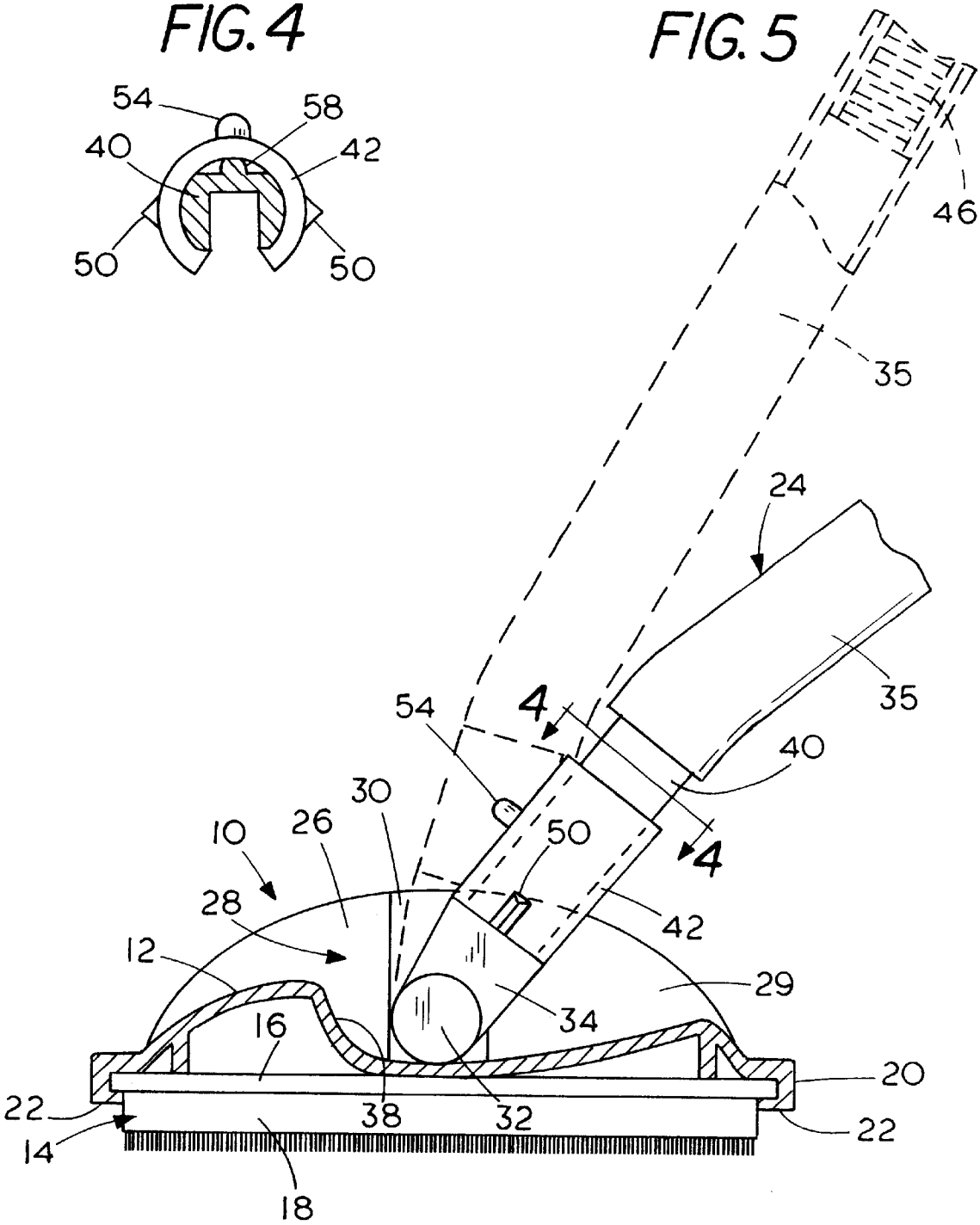
FIG. 4 is a sectional view taken as on line 4—4 in FIG. 5.
FIG. 5 is a sectional view of the paint pad taken substantially on the same line as FIG. 3, but showing the handle in two different positions for operation.

A paint pad holder indicated generally at 10 has a paint pad holder plate 12 that is made to support and retain a standard paint pad 14 that has a backing plate 16, a foam layer 18, and a soft paint applying snap layer 18. Paint pad holder plate 12 is a molded plastic plate that has a flange 20 receive the backing sheet 16 and suitable clips such as those shown at 22 in FIGS. 3 and 5 are used for retaining the backing sheet 16 in place. The paint pad holder plate 12 is made to be attached to a handle assembly 24, in a raised center housing portion 26 of the paint pad holder plate 12. The raised center housing portion 26 has a passage or recess 28 that extends from the front to the back, and defines a guide between side walls 29 for supporting the handle assembly 24. The recess extends generally perpendicular to the longitudinal length of the pad holder plate. Recess 28 has slots 30 in the opposite side walls 29 for receiving the pivot pins or shaft ends 32 mounted on the handle assembly 24 through a support block 34 that fits within the recess 28. The support block is mounted on a handle grip 35.

Additionally, raised center housing portion 26 has lock slots 36A and 36B defined in the opposite side walls 29 of the recess 28. The lock slots 36A and 36B are used for adjusting the angle of the handle assembly 24, as will be explained.

The guide recess 28 has a bottom wall 38 that is formed to permit swiveling movement of the handle assembly 24 about the axis of the pivot pins 32. The axis of pivoting is generally parallel to the longitudinal length of the pad holder plate.

The handle assembly 24 includes the mounting block 34, mounting the pivot pins 32, and includes a shank 40 that is reduced in size and made to receive a sliding snap on lock sleeve or collar 42. The sleeve 42 is made to slide a limited amount along the shank 40. The hand grip portion 35 of the handle is hollow, for lightweight, and also to form a bore 43 to receive a threaded insert 46 on the interior of the handle that will permit threading on extension handles in a normal manner. The threaded insert 46 is a split plastic molded sleeve that slides into the hand gap bore 43 and is held with small pins 44 that will seat in openings 45.

The sliding lock sleeve 42 has a pair of side lock projections 50, that are made to fit into the slots 36A and 36B, on walls 29 on opposite sides of the recess 28. In addition, there is a thumb actuator projection 54 on the front side of the lock sleeve 42 that can be used for pushing the lock sleeve along the shank or guide 40 of the handle assembly 24.

As shown, the side walls 29 of recess 28 are parallel, and define the sides of the recess and guide pivoting of the handle assembly. The slots 30 along the sides of the recess that receive the pins 32 can be made so that they will have small portions that project to retain the pins 32 in place near the bottom of the slots 30 for pivotal movement of the handle about the axis of the pins 32.

As shown in FIG. 3, the raised center housing portion 26 of the pad support plate 12 is formed with the bottom wall 38 molded in a configuration that will permit the handle 24 to pivot about the axis of the pins 32 at several different angles. The slots 36A and 36B are positioned at angles that are normally used for hand operated painting along a vertical surface, and the adjustments can be made for individual use. Additionally, the lock sleeve 42 can be slid up so that it clears the upper surface of the housing portion 26. As shown in the dotted line position in FIG. 5, when the lock sleeve 42 is raised so that it clears the upper surface of the raised center portion 26, the handle assembly 24 can be pivoted about the axis of the pins 32 freely. Then if someone adds an extension handle in the insert 46, the pad holder will pivot to stay flat as the paint pad is moved on a vertical surface or as it is moved along a horizontal overhead surface.

The shank portion 40 can have a small raised knob or rib shown at 58 in FIG. 4, to bear against the lock sleeve 42 so that the lock sleeve will stay in place until it is manually moved using the thumb projection 54.

Any type of lock or retainer handle can be utilized for holding the handle assembly in a fixed position, but the use of a multiple position lock, as well as a floating mode of the pivoting handle is useful in many different painting applications, and greatly adds to the utility of the pad holder.

Although the present invention has been described with reference to preferred embodiments, workers skilled in the art will recognize that changes may be made in form and detail without departing from the spirit and scope of the invention.

What is claimed is:

1. A pad holder comprising a pad holder plate adapted to receive a painting pad and a handle, the pad holder plate having a handle mounting housing, said handle mounting housing having a first recess formed with parallel spaced side surfaces for receiving the handle, the first recess extending laterally generally perpendicular to a longitudinal length of the plate, the handle having a head member for being received in the first recess, and the head member having a pin mounted in the handle mounting housing in a second recess open to at least one side surface of the first recess for pivotal movement of the handle relative to the pad holder plate about an axis generally parallel to a plane of the plate with the head member moving between the side surfaces of the first recess, a slidable latch member on the handle movable from a release position to permit the handle to pivot at least a selected amount, to a latched position for engaging one of a plurality of stops formed on the handle mounting housing of the pad holder plate.

2. The pad holder of claim 1, wherein the head member has a pair of pins on opposite side thereof, and pin receiving slots defined in side walls of the first recess for pivotally mounting the pins.

3. The pad holder of claim 1 wherein said latch member comprises a lock sleeve slideably mounted on the handle, said lock sleeve having projections thereon for mating into slots formed on the housing for the handle, the slots comprising the stops on the pad holder plate.

4. The pad holder of claim 3, wherein said side surfaces of the first recess of the handle mounting housing define a path for guiding the handleas the handle pivots, sides of the handle mounting housing adjacent the first recess having spaced from the slots therein for receiving projections on the lock sleeve.

5. The pad holder of claim 4, wherein said pad holder is molded from a plastic material.

6. The pad holder of claim 5, wherein said handle and said handle mounting housing on the plate are separately molded, and can be snapped together.

7. The pad holder of claim 1, wherein said handle is hollow, and a threaded insert for inserting into an end of said handle for receiving a threaded extension member.

8. The paint pad holder of claim 1 wherein said latch member has projections thereon for mating into slots formed on the handle mounting housing.

9. A molded plastic paint pad holder comprising a pad holder plate adapted to receive a painting pad, and the pad holder plate having a handle mounting housing in center portions thereof, a handle guide recess in the handle mounting housing, the handle mounting housing having pin receiving receptacles extending laterally from the handle guide recess, a handle having a head member, a pair of pins on the head member extending into the receptacles and retained for pivotal movement of the handle relative to the pad holder plate about a pin axis generally parallel to a plane of the plate, a lock sleeve slideably mounted on the handle and slidable on the handle away from the handle mounting housing to a release position to permit the handle to pivot freely about the pin axis for a selected amount relative to the pad holder plate, and the lock sleeve being slidable to a latched position engaging one of a plurality of stops formed on the handle mounting housing for holding the handle in one of a selected number of pivotal positions.

10. A paint/pad holder comprising a pad holder plate adapted to receive a painting pad on a first surface thereof, the pad holder plate having a handle mounting housing in center portions thereof raised upwardly from a surface of the plate opposite from the first surface, and having a recess with spaced side recess surfaces and upwardly opening pin receiving receptacles extending laterally outwardly from the side recess surfaces and the receptacles opening to a top of the handle mounting housing, a handle having a head member with handle side surfaces which fit between the side recess surfaces, a pair of pins on the head member extending into the pin receiving receptacles and retained in the pin receiving receptacles for pivotal movement of the handle relative to the pad holder plate about a pin axis generally parallel to a plane of the plate, a lock sleeve slidably mounted on the handle above the handle mounting housing and slidable in direction away from the handle mounting housing to a release position to permit the handle to pivot about the pivot axis of the pins a selected amount relative to the pad holder plate, and the lock sleeve being slidable toward the handle mounting housing to a latched position engaging stops formed on the handle mounting housing for holding the handle in one of a selected number of positions about the pivot axis.

* * * * *